United States Patent [19]

Davis

[11] Patent Number: 4,969,314

[45] Date of Patent: Nov. 13, 1990

[54] CUP BAGGER CHUTE

[76] Inventor: Robert Davis, 7305 Woodbine Avenue, Unit #519, Markham, Ontario, L3R 3V7, Canada

[21] Appl. No.: 329,190

[22] Filed: Mar. 27, 1989

[51] Int. Cl.[5] ..... B65B 35/32; B65B 35/44; B65B 43/36

[52] U.S. Cl. ..... 53/572; 193/17; 198/706; 198/713

[58] Field of Search ..... 53/572, 53, 54, 167, 53/247, 147; 198/397, 706, 713; 193/11, 17

[56] References Cited

U.S. PATENT DOCUMENTS 3,795,305 3/1974 Sandvik ..... 198/706
4,302,331 11/1981 Condit, Jr. ..... 198/713 X
4,401,242 8/1983 Bonomo ..... 193/17 X
4,798,042 1/1989 Davis ..... 53/572
4,813,205 3/1989 Mikata et al. ..... 53/53

*Primary Examiner*—Horace M. Culver

[57] ABSTRACT

The present invention provides a machine for bagging contained liquid products and includes a product dispenser, a product bagger and a chute from the product dispenser to the product bagger. The chute is designed to eliminate or at least substantially eliminate product leakage from reaching the bagger and comprises a lower chute section having an open frame liquid draining construction and an upper chute section which is movable from a product feed to a product divert position relative to the lower chute section for diverting any leaking product away from the bagger.

4 Claims, 8 Drawing Sheets

FIG.1.
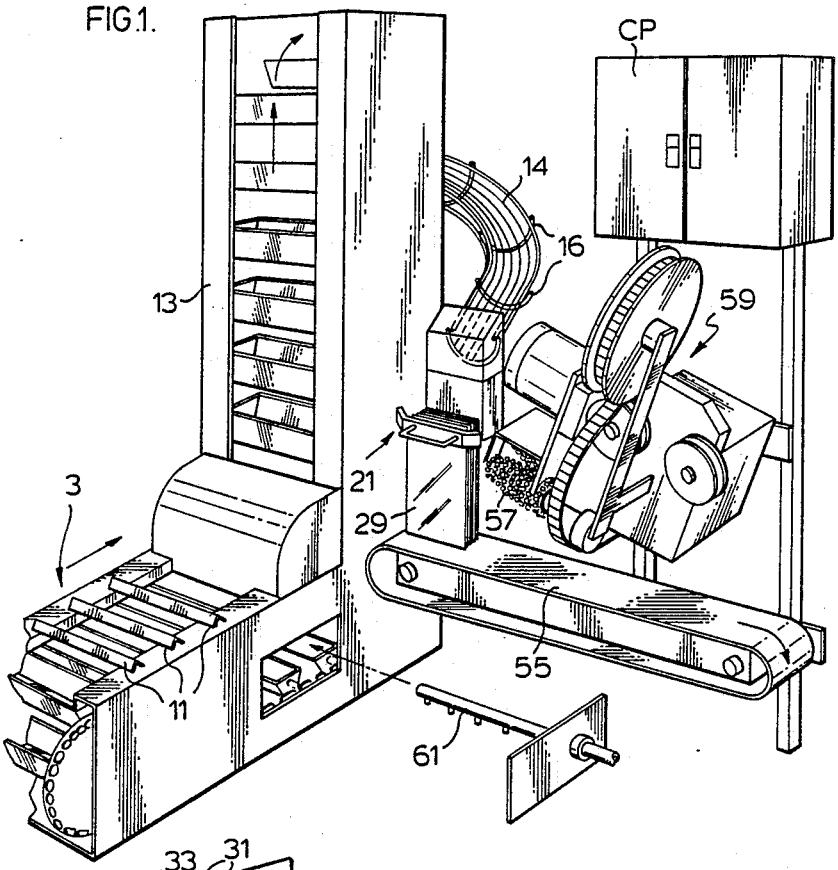
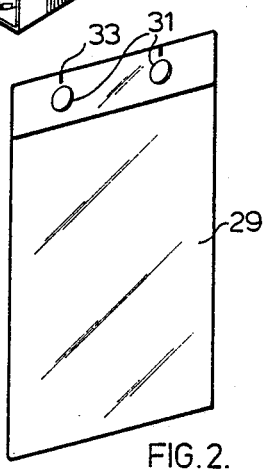
FIG.2.
FIG.3.
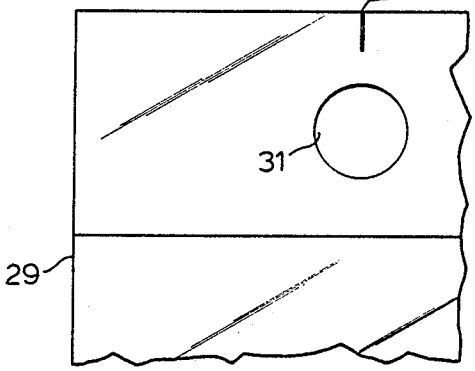

CUP BAGGER CHUTE

FIELD OF THE INVENTION

The present invention relates to an article bagging machine particularly designed for the bagging of individual portioned creamer cups.

BACKGROUND OF THE INVENTION

In the creamer cup industry, where individual portions of cream are contained in a single small cup, these cups, according to standard practice, are bulk packaged in cardboard boxes. This is both an awkward as well as an expensive method of packaging the individual cups.

Many other small liquid containing products are bulk packaged in cardboard boxes in the manner described above and therefore there is a need for a replacement, inexpensive and convenient method of bulk packaging small articles.

The single cup individual cream portions as mentioned above as well as other types of liquid contained products are susceptible to at least the occasional leaker where the untrapped liquid will then flow down with the product into the package. Even a relatively small amount of leakage will make all of the product in the package unsaleable.

SUMMARY OF THE PRESENT INVENTION

The present invention provides a packaging machine particularly designed for the packaging of contained liquid products. The machine is designed to avoid the entrapment of product leakage in the package.

More specifically, the packaging machine of the present invention comprises a dispenser for the dispensing of contained liquid product, a bagger for bagging of the product and a transfer chute from the dispenser to the bagger. The chute itself comprises a lower chute section having an open frame liquid draining construction and an upper chute section which is movable from a product feed to a product divert position relative to the lower chute section.

In the event that leakers are dispensed from the dispenser, the upper chute section is moved to the divert position to dispose of the leakers. If any of the product which is leaked is not diverted immediately, it then has a tendency to drain through the lower chute section rather than flowing down to the bagger.

BRIEF DESCRIPTION OF THE DRAWINGS

The above as well as further advantages and features of the present invention will be described in greater detail according to the preferred embodiments of the present invention in which:

FIG. 1 is a perspective view of a bagging machine according to a preferred embodiment of the present invention;

FIG. 2 is a perspective view of one of the bags used in the machine of FIG. 1;

FIG. 3 is a front view of the upper corner mounting area of the bag of FIG. 2;

DETAILED DESCRIPTION ACCORDING TO THE PREFERRED EMBODIMENTS OF THE PRESENT INVENTION

Figure 4:
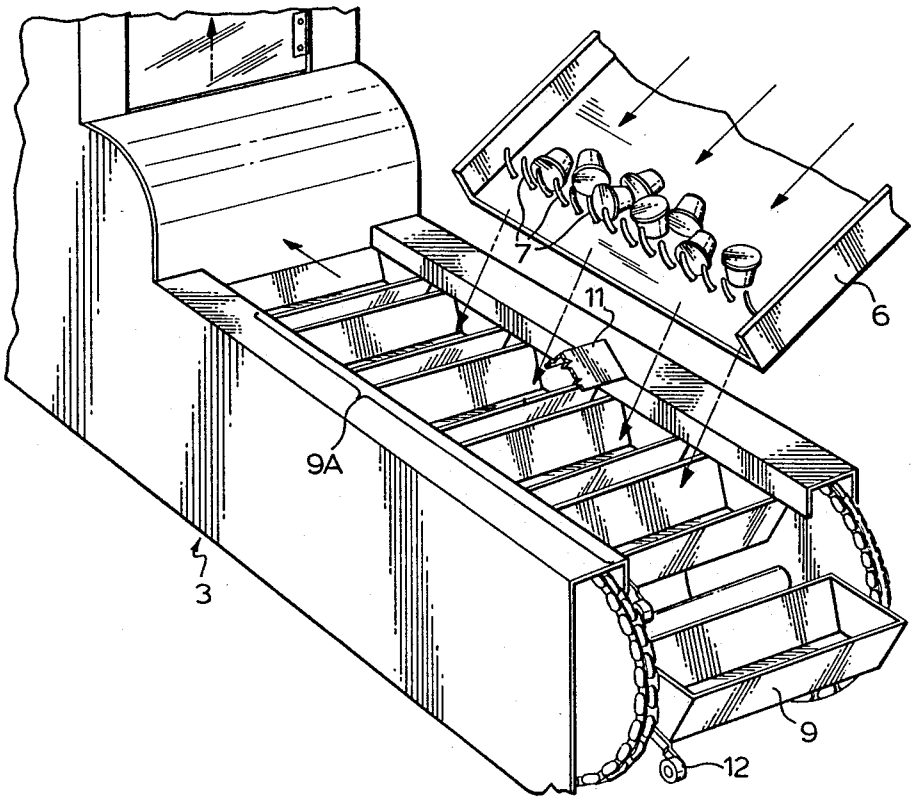
FIG. 4 is a perspective view of an indexer used in combination with the bagging machine of FIG. 1 according to a further preferred embodiment of the present invention.

FIG. 1 shows a bagging machine generally indicated at 1. FIG. 4 shows an indexing machine generally indicated at 3. The present invention in its broadest aspect relates to the bagging machine. However, a further aspect of the present invention incorporates the combination of the indexing and bagging machines to form a unitary indexing and bagging machine.

Figure 5:
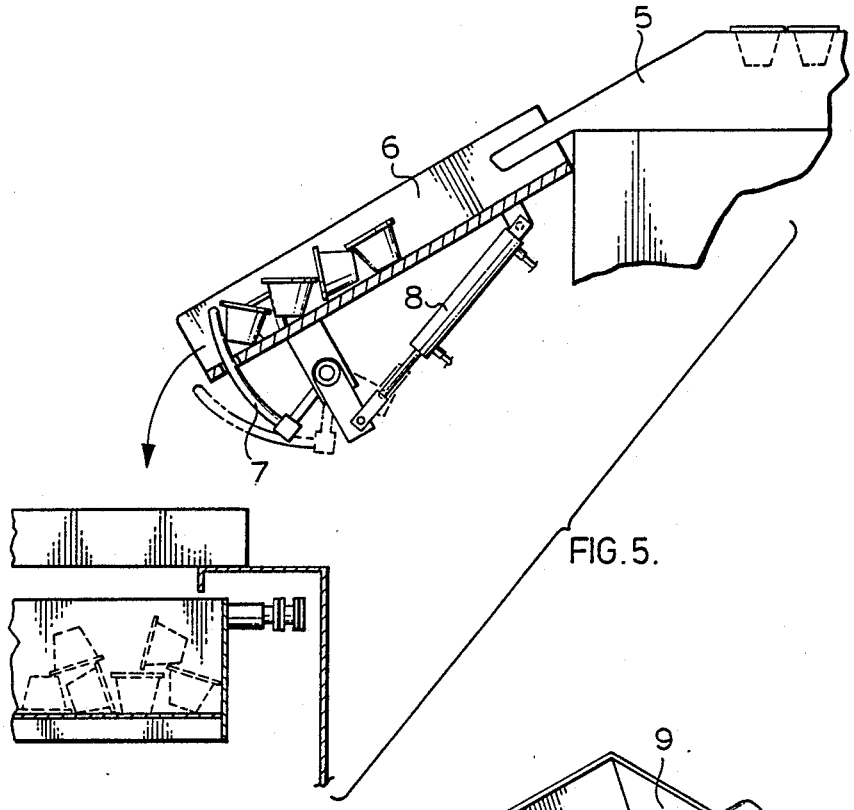
FIG. 5 is a side view showing the indexer of FIG. 4 in operation.

In light of the above, reference is first had to FIGS. 4 and 5 of the drawings where the indexer comprises an upper collector 5 fed from a large supply of individual articles and in this case single serving coffee or creamer cups. The collector operates in a conventional manner to index a specified number of the cups which are then collected on a collector tray 6. This collector tray includes a movable claw-like stop 7 which sits in the stop position seen in FIG. 4 until the specified number of cups have collected on the tray. At that point the claw is retracted by control piston 8 as seen in FIG. 5 so that the cups drop into collector baskets 9. These collector baskets are set up in groups such as group **9*a* to receive the indexed number of cups which will then be used for a single bag filling. A series of V-shaped deflector bars 11 also seen in FIG. 4 are provided for an even distribution of the cups between the baskets in group 9*a***.

All the baskets are pivotally mounted to a drive system and in this particular case a chain drive as seen in FIGS. 1 and 4 of the drawings. Each group of baskets, after having picked up its quota of cups moves from the indexing region 3 in the direction of the arrows shown in FIG. 1 up a tower 13. As the individual baskets clear over the top of the tower they are deflected by means of deflectors 12 provided on each of the baskets and catching on the tower causing them to dump their loads onto a downwardly twisting chute. The lower end of this chute, best seen in FIGS. 7 and 8 of the drawings, feeds directly to a bag preset to receive the cups as described later in detail.

The chute comprises upper and lower chute sections 15 and 14 respectively. The lower chute section 14 is designed for maximum efficiency and cleanliness. More particularly, it is formed by a plurality of spaced apart rounded ribs or rails secured at spaced junctures by brackets 16. This arrangement minimizes friction between the cups and the chute and provides an automatic drainage of liquid spilling from any damaged cups that might otherwise pass down the chute. In other words, the drainage occurs directly through rather than down the chute and does not spill into the bag. In this regard, the rounded construction of the rails forming the lower chute section enhances drippage through rather than flow along the lower chute section of any leaked liquid that might otherwise reach the bagger.

Figure 15:
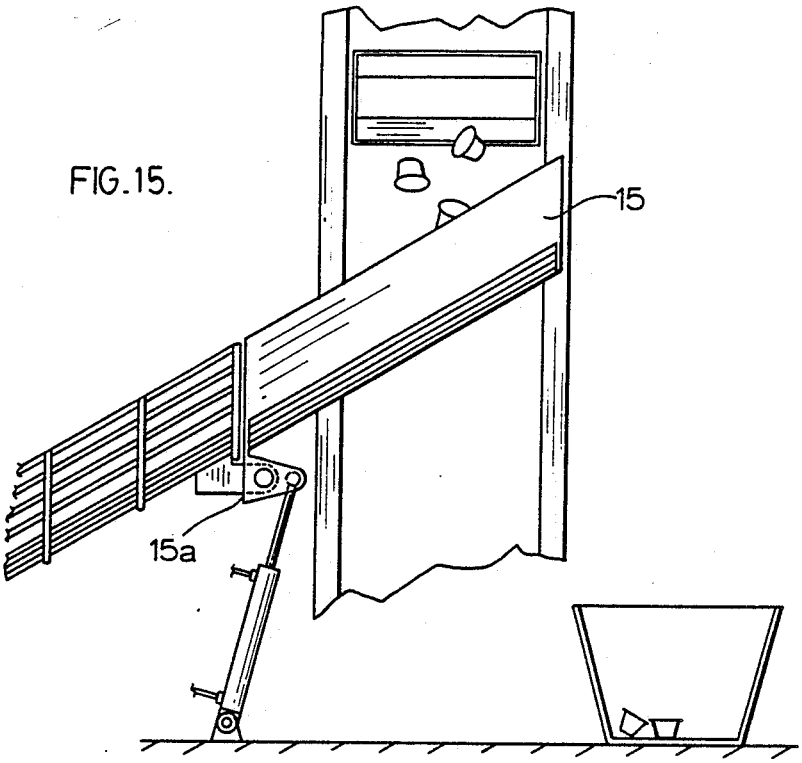
FIG. 15 is a rear view of the dispenser and upper chute region of the machine of FIG. 1 when in the feed position.
Figure 16:
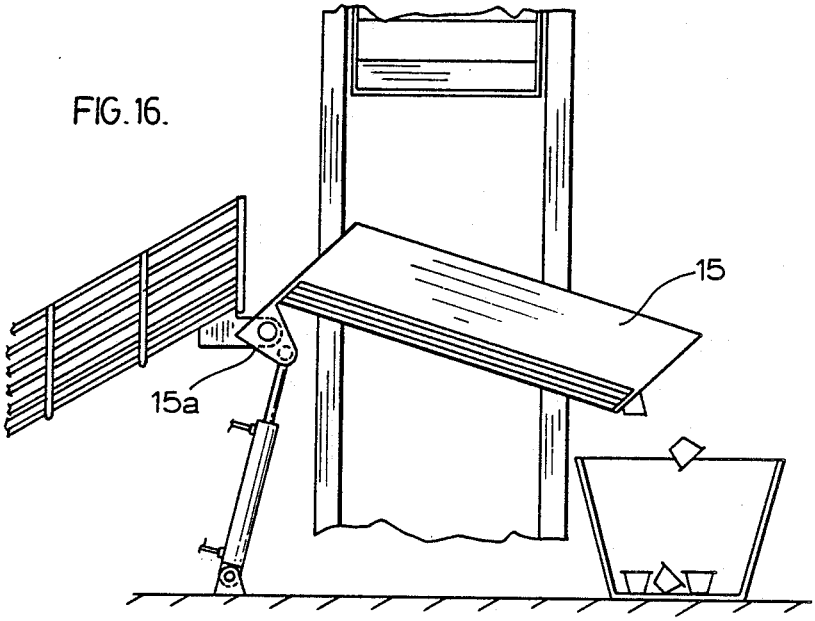
FIG. 16 is a view similar to FIG. 15 with the upper chute section in the divert position.

The upper chute section 15 is best seen having reference to FIGS. 15 and 16 of the drawings. This upper chute section is fed directly from the dispensing baskets which as earlier described dump their loads directly onto the upper chute section. In the normal operating position as shown in FIG. 15 of the drawings, the upper chute section aligns with and feeds down onto the lower chute section.

In the event that there is product leakage, upper chute section 15 which is hingedly connected at 15*a* to the lower chute section is movable from its normal feed position to a divert position as shown in FIG. 16 of the drawings. In this divert position, the upper chute section hinges about its lower end to tip the upper end of the upper chute section downwardly into a waste container or the like. Note that in the preferred embodiment, the upper chute section has a solid construction so that it is designed, unlike the lower chute section, to encourage the flow of leaked product down into the waste container.

Figure 7:
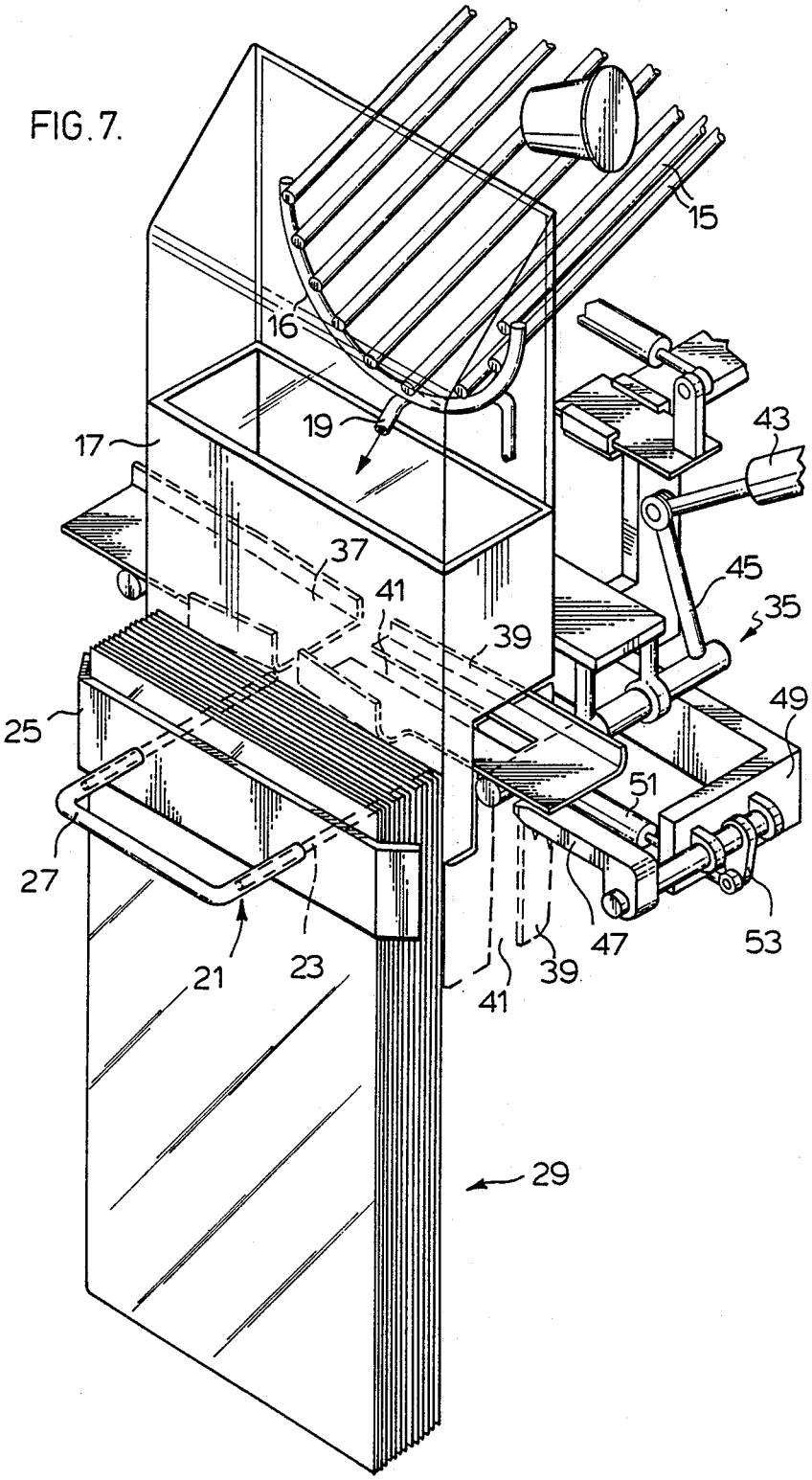
FIG. 7 is an enlarged perspective view of the bag mounting and filling region of the machine of FIG. 1.

Chute 14 feeds down into a collector or funnel 17, the front wall of which is provided with a bag support, known in the trade as a wicket plate, generally indicated at 21 in FIGS. 1 and 7. Also directed down into the collector is an air nozzel 19.

Bag support or wicket plate 21 comprises a pair of prong-like members 23 for receiving a plurality of stacked bags or wicketed 29. These bags, best seen in FIGS. 2 and 3 of the drawings, are provided at their upper ends with a pair of openings 31 on the lengthened back panel of the bags for fitting over the prong-like members 23. Here it should be noted that the mouth of each bag, although pressed tightly together is not sealed shut which allows opening of the bag by means such as a suction cup or a pneumatic bag opener again to be described later in detail. Also note that the back panel of the bag is provided with a downward slit 33 directly above each of the openings 31. The function of these will also be described later in detail.

After a number of the bags have been placed over prong-like members 23 a weighted guard and bag guide 25 having a handle 27 is fitted over and covers the prongs. This weighted quide tends to push the bags inwardly towards collector 17 where the most inwardly positioned bag, i.e. the bag to the front of the stack, is exposed to compressed air blown out from nozzle 19 to open that particular bag. The timing of the operation is such that the bag is opened prior to the feeding of the cups from the chute.

Figure 8:
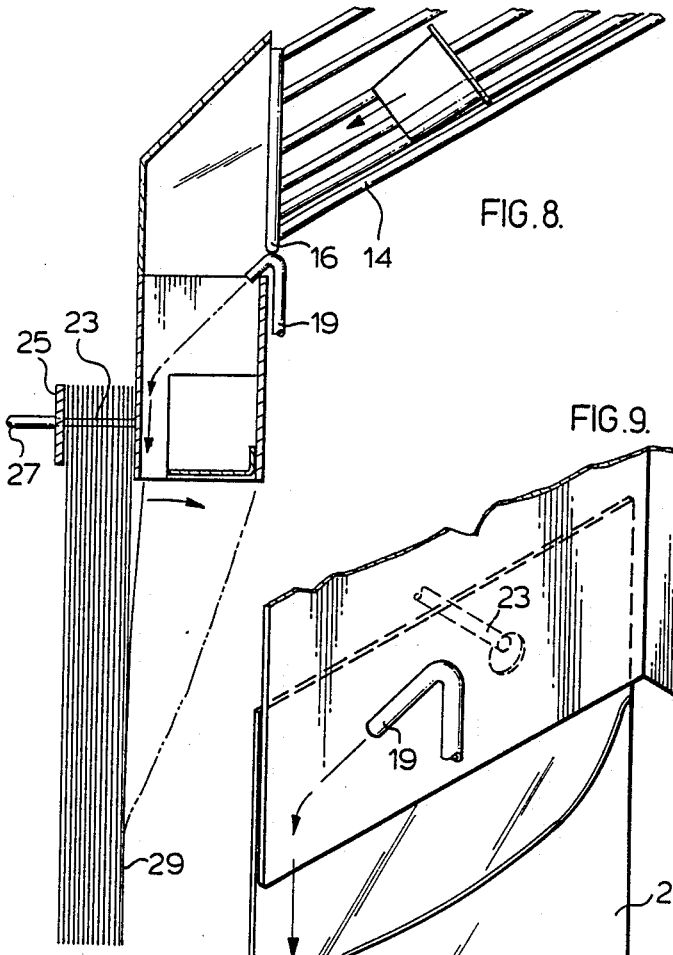
FIG. 8 is a side view of the bag mounting region of FIG. 1.
Figure 9:
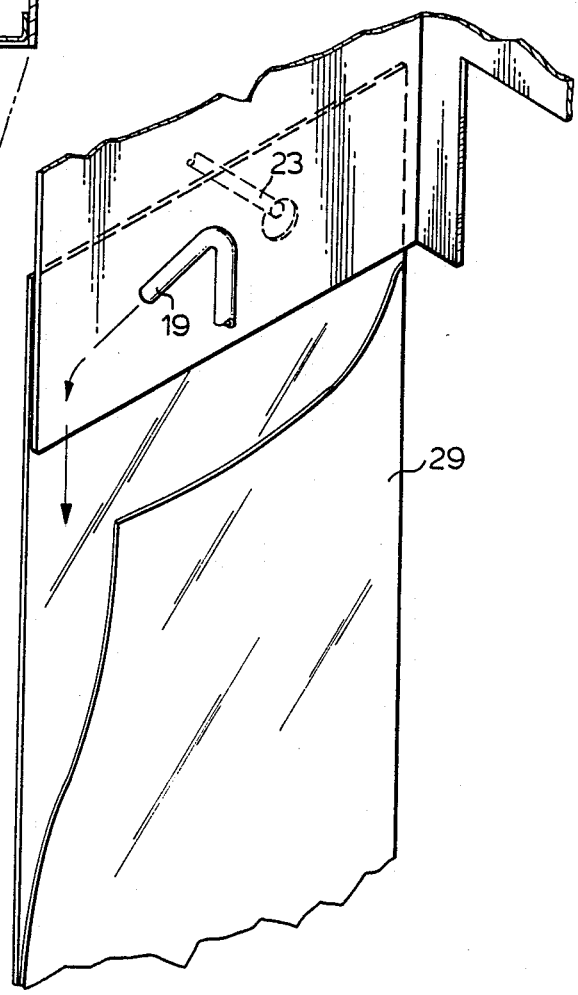
FIG. 9 shows the fitting of a bag to the bag mounting region of FIG. 8.
Figure 10:
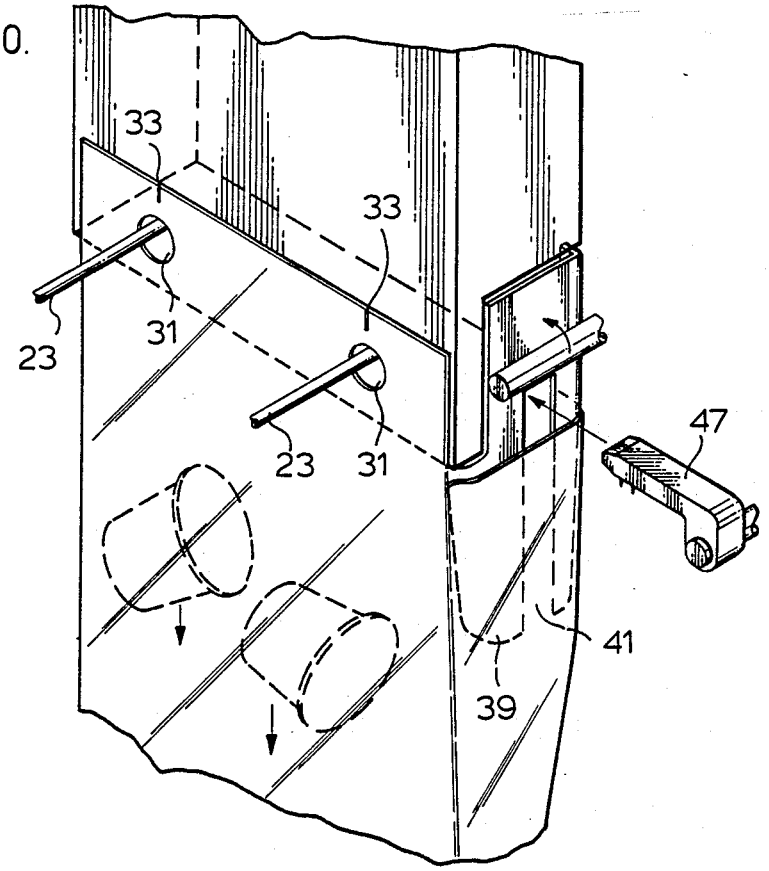
FIG. 10 shows the stretching and filling of one of the bags as fitted to the bag mounting region shown in FIG. 8.
Figure 11:
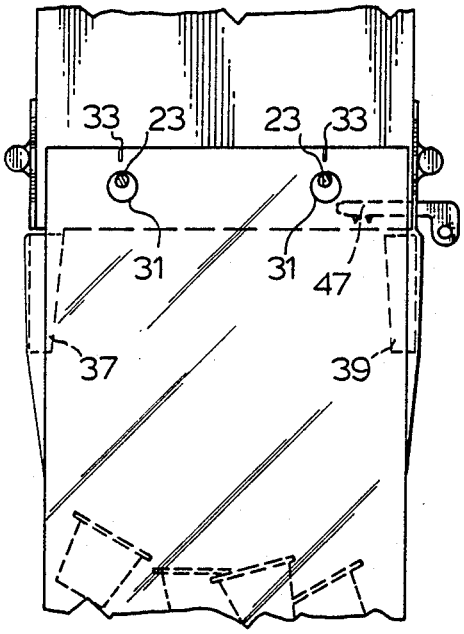
FIGS. 11 and 12 are front views showing in sequence the gripping and pulling of the bag from the bag mounting region after filling as per FIG. 10.
Figure 12:
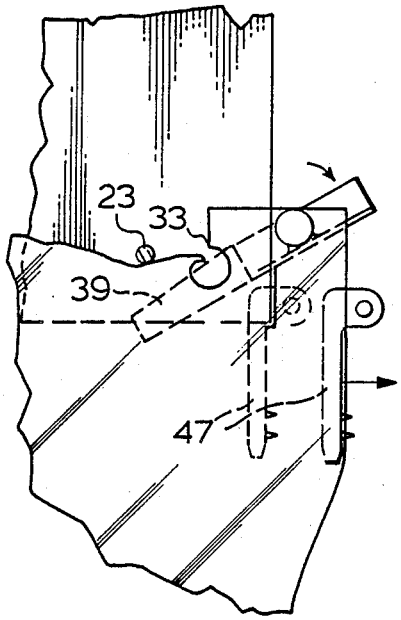

The complete opening of each bag is done with more than just the compressed air which provides an initial separation of the bag mouth as best seen in FIG. 8 of the drawings. Here it will be noted that the bag is actually formed whereby the front panel of the bag is lower than the back supporting panel of the bag allowing the front panel to be blown into the dotted line position in FIG. 8 without affecting any of the bags in the rear of the stack, i.e. the back panel on the bag acts as a deflector to guide the opening of the front panel and to prevent any air flow from nozzle 19 past the most forward bag in the stack. After the bag has been initially opened by the air flow as shown in FIG. 8, it is then further stretched open by means of a stretcher assembly, generally indicated at 35, the components of which can be well seen in FIG. 7 in perspective and the operation of which is best shown in FIGS. 10 through 12 of the drawings. More particularly, the stretcher assembly comprises a pair of pivotal flaps 37 and 39 which are adjustable in spacing between one another according to the bag size. These flaps are in the up position as shown in FIG. 7 during the initial blow opening of the bag and which then pivot to the down position as shown in FIG. 10 for a wide open stretching of the bag. They not only act as guide members to ensure proper feed from chute 14 into the stretched open bag but also in the case of relatively light load, such as creamer cups, provide support or hold the bag from above without any assist from beneath the bag.

The actual pivoting or up/down movement of flaps 37 and 39 is controlled by means of a lever assembly comprising pivotally coupled piston 43 and arm 45 which move the two flaps and in particular flap 39 as shown in FIG. 12 of the drawings. Note that the two flaps have a downward tapering which eases their fitting into and out of the bag.

After the supply of cups has been fed down into the bag it is then pulled off the stretcher assembly by a finger like gripper 47 mounted to a sliding carriage 49. Gripper 47 slides in an up position horizontally with carriage 49 as shown in FIG. 10 of the drawings directly through slot 41 of flap 39 still in its down position. The gripper, once reaching its figure 11 position, is then pivoted downwardly to a vertical extending position by piston 51 and pivot mount 53 seen in FIG. 7 pierce and to grip on the bag as shown in FIG. 12 of the drawings. The slide carriage with the gripper remaining in the down position is then moved away from the bag support area pulling the upper part of the bag off of the bag support at which point the lower heavy part of the bag then drops down onto and is carried by conveyor 55. Again, having reference to FIG. 12 it will be seen that as the finger gripper pulls the upper end of the bag, flap 37 is timed to move back to its up position as does flap 39 allowing the bag to clear past the two flaps.

As earlier described, each of the bags is supported by fitting prong-like members 23 through holes 31 on the taller back panel of the bag. As also described, the bag is weakened at 33 directly in line with each of the holes. This weakening does not affect the bags ability to support itself, but does provide a tear region which gives way with the added force applied to the bag by means of gripper 47. With this arrangement, as can be seen in FIG. 13 of the drawings, the bag is simply pulled off of prongs 23 giving way at 33 without leaving any part of the bag on the bag support and therefore not interfering with the next bag to be presented for filling.

Figure 13:
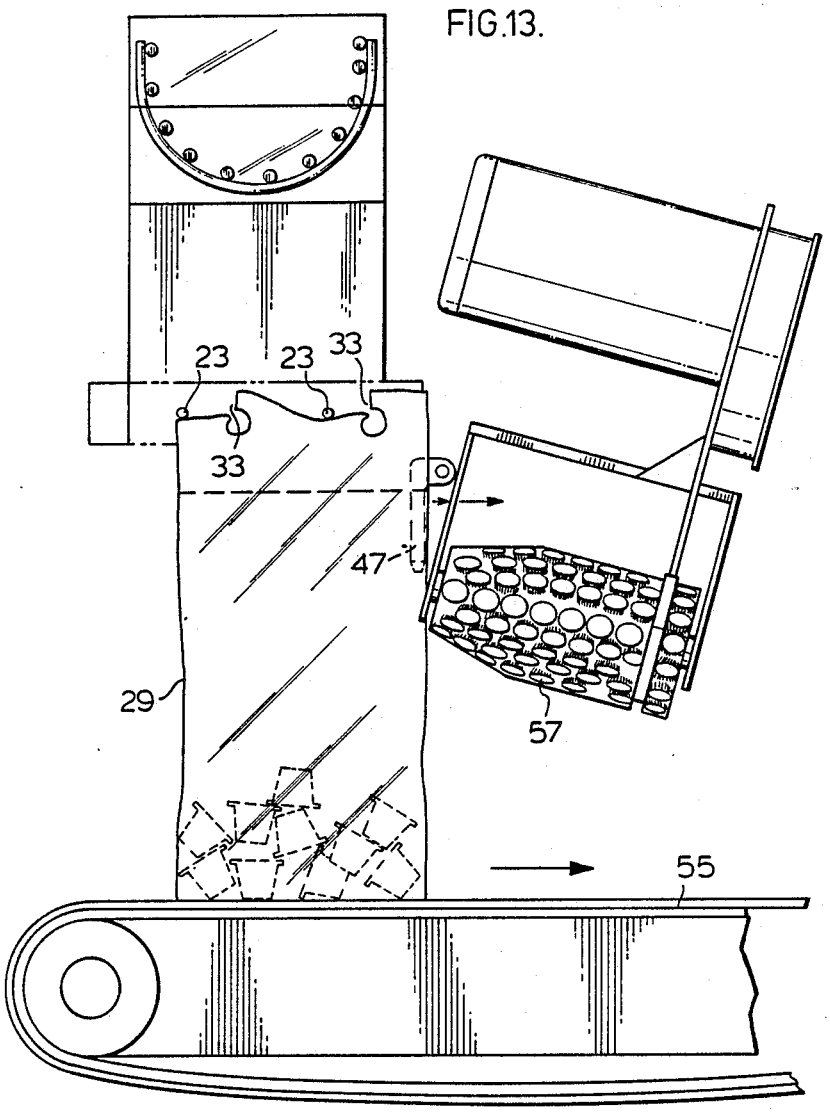
FIG. 13 is a further front view showing movement of the full bag to the applicator for applying the closure to the top of the bag.
Figure 14:
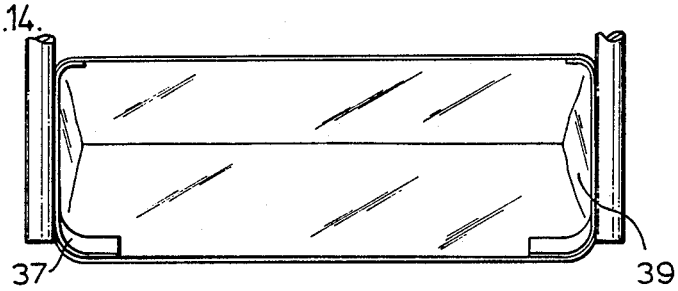
FIG. 14 is a top view looking down into a stretched open bag as per FIG. 10.

The bag being pulled away as shown in FIG. 13 is carried by the gripper and the conveyor to a pair of rotating brushes 57, shown in both FIGS. 1 and 13 of the drawings. These brushes which are bristled for handling the bag rotate in opposite directions, i.e. towards one another, and are angled so as to both collapse the neck of the bag and to assist conveyor 55 in passing the bag along to a closure applicator 59. Each of the brushes has a frustoconical end region providing gap between the brushes for initial insertion of the bag between the brushes and the brushes themselves are adjustable in position to privide the required amount of pressure on the bag depending on its weight for carrying it to the closure applicator.

As will be appreciated, many different kinds of closure applicators can be used with the particular applicator being shown comprising a KWIK LOK TM applicator for securing about the neck of the bag which, as described above, has been precollapsed or bunched by brushes 57 specifically for the application of the closure.

The timing of all of the components including the opening and feed to the bag, the pulling or removal of the bag from the bag support and the transporting of the bag to the closure applicator is controlled through control panel CP as seen in FIG. 1 of the drawings.

Figure 6:
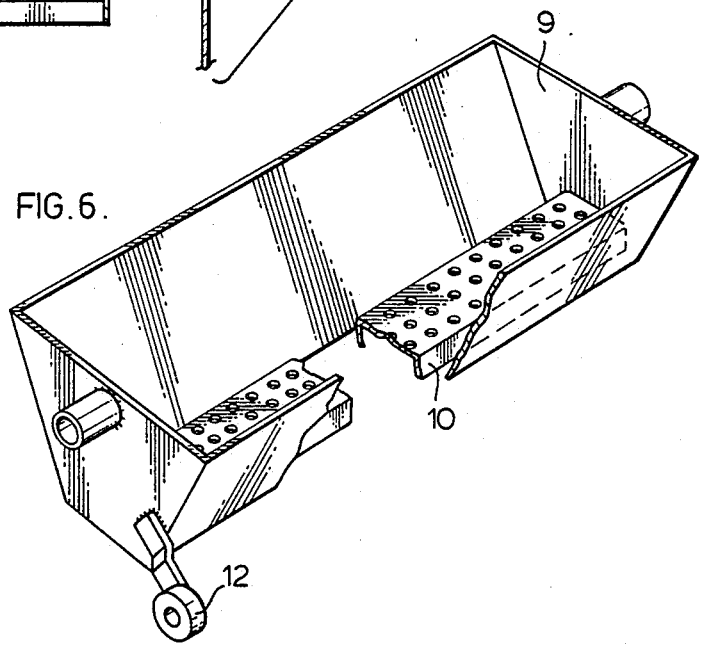
FIG. 6 is top perspective view of a carrying tray used in the bagging machine of FIG. 1.

As earlier described, chute 14 is designed for automatic draining in the event of inadvertant spillage from the cups. As a further cleaning feature of the machine, each of the baskets 9 for carrying the cups to the feed chute has a perforated bottom 10 as shown in FIG. 6 of the drawings. This perforated bottom not only provides a self draining feature, but also allows cleaning of the empty basket by a spray bar 61 as seen in FIG. 1 of the drawings positioned to clean the baskets prior to returning to the pick-up point from the cup indexer.

Two particularly unique features of the present invention are the spreading and supporting of the bag by the bag stretcher and the sideways pulling of the bag from the bag support. With respect to the first feature, this substantially reduces complications by not having to provide some type of timed moving surface beneath the bag as it is being loaded. With respect to the second feature, the sideways as opposed to forward or rearward removal of the bag from the bag support, eliminates the bag material on and fouling of the inner ends of the prongs on the bag support.

It will now be seen how the present invention provides a simple yet efficient means for bagging milk cups using inexpensive yet easily handled plastic bags. It will be further appreciated that this bagging technique can equally as well be used with other typically small articles. Further, although various preferred embodiments of the invention have been described in detail, it will be understood that variations can be made to those embodiments without departing from the spirit of the invention or the scope of the appended claims.

The embodiments of the invention in which an exclusive property or privilege is claimed are defined as follows:

1. A chute in a contained liquid product bagging system having a product dispenser and a product bagger which is fed from said product dispenser down along said chute, said chute comprising an upper chute section at said product dispenser and a lower chute section to said product bagger, said lower chute section having an open frame liquid draining construction and said upper chute section being movable from a product feed to a product divert position relative to said lower chute section.

2. A chute as claimed in claim 1, wherein said upper chute section has a product receiving upper end and a lower end hingedly secured to said lower chute section, said upper chute section being of a solid construction and at least generally in line with said lower chute section when in said product feed position and hinging out of line with said lower chute section to tip said upper end downwardly relative to said lower chute section when in said divert position.

3. A chute as claimed in claim 1, wherein open frame construction comprises rounded drip inducing rails in said lower chute section.

4. A dispenser arrangement in a contained liquid product bagging system having a product bagger which is fed from said product dispensing arrangement, said arrangement comprising a plurality of baskets carrying the products to a chute which feeds the product to said product bagger, said chute comprising upper and lower chute sections, said lower chute section having an open frame liquid draining construction and said upper chute section being movable from a product feed to a product divert position relative to said lower chute section, each of said baskets having a perforated bottom for self-cleaning of said baskets, said system further including spray cleaning means for cleaning through the perforated bottoms of the baskets.

* * * * *